US010751244B2

(12) United States Patent
Yang et al.

(10) Patent No.: US 10,751,244 B2
(45) Date of Patent: Aug. 25, 2020

(54) FINGER JOINT REHABILITATION DEVICE

(71) Applicants: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

(72) Inventors: Keqiang Yang, Beijing (CN); Zhenwei Mao, Beijing (CN); Keijiron Yamamoto, Kanagawa (JP)

(73) Assignees: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

( * ) Notice: Subject to any disclaimer, the term of this patent is extended or adjusted under 35 U.S.C. 154(b) by 0 days.

(21) Appl. No.: 16/626,348

(22) PCT Filed: Jul. 3, 2018

(86) PCT No.: PCT/CN2018/094197

§ 371 (c)(1),
(2) Date: Dec. 24, 2019

(87) PCT Pub. No.: WO2019/007312

PCT Pub. Date: Jan. 10, 2019

(65) Prior Publication Data

US 2020/0113770 A1 Apr. 16, 2020

(30) Foreign Application Priority Data

Jul. 7, 2017 (CN) ..... 2017 1 0552279

(51) Int. Cl.
*A61H 1/00* (2006.01)
*A61H 1/02* (2006.01)

(52) U.S. Cl.
CPC ..... *A61H 1/0288* (2013.01); *A61H 1/024* (2013.01); *A61H 1/0277* (2013.01);
(Continued)

(58) Field of Classification Search
CPC ..... B25J 9/104; B25J 9/1694; B25J 9/0006; A61H 3/00; A61H 1/0288;
(Continued)

(56) References Cited

U.S. PATENT DOCUMENTS 4,274,399 A * 6/1981 Mummert ..... A61H 1/0288 601/40
4,671,258 A * 6/1987 Barthlome ..... A61H 1/0288 128/DIG. 20
(Continued)

FOREIGN PATENT DOCUMENTS

CN 201164564 Y 12/2008
CN 204121369 U 1/2015
(Continued)

*Primary Examiner* — Tu A Vo
(74) *Attorney, Agent, or Firm* — Bayramoglu Law Offices LLC

(57) ABSTRACT

A finger joint rehabilitation device includes at least one of an index finger joint rehabilitation exercise aid part, a middle finger joint rehabilitation exercise aid part, a ring finger joint rehabilitation exercise aid part, a little finger joint rehabilitation exercise aid part and a thumb joint rehabilitation exercise aid part; at least one corrugated tube; one protective brace fixed on a wrist and a palm; and the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part are all provided with the corrugated tube and are all fixed on the protective brace.

9 Claims, 8 Drawing Sheets

(52) U.S. Cl.
CPC ..... *A61H 2201/0107* (2013.01); *A61H 2201/0157* (2013.01); *A61H 2201/1238* (2013.01); *A61H 2201/1409* (2013.01); *A61H 2201/165* (2013.01); *A61H 2201/1638* (2013.01); *A61H 2205/06* (2013.01); *A61H 2205/067* (2013.01); *A61H 2205/10* (2013.01); *A61H 2205/102* (2013.01)

(58) Field of Classification Search
CPC .... A61H 2201/1238; A61H 2201/1409; A61H 2201/1638; A61H 2201/165; A61H 1/00; A61H 1/02; A61H 1/0237; A61H 1/024; A61H 1/0244; A61H 1/0255; A61H 1/0285; A61H 1/0262; A61H 1/0274; A61H 2201/0103; A61H 2201/5056; A61H 9/00; A61H 9/0078; F15B 15/10; F15B 15/103
See application file for complete search history.

(56) References Cited

U.S. PATENT DOCUMENTS

| | | | | |
|---|---|---|---|---|
| 6,565,563 | B1 * | 5/2003 | Agee | A61B 17/6425 602/21 |
| 2010/0280424 | A1 * | 11/2010 | Kawakami | B25J 9/0006 601/33 |
| 2011/0118635 | A1 * | 5/2011 | Yamamoto | A61H 1/0237 601/5 |
| 2012/0029399 | A1 * | 2/2012 | Sankai | A61H 1/0288 601/40 |
| 2013/0226350 | A1 * | 8/2013 | Bergelin | A61H 1/0288 700/275 |
| 2013/0338556 | A1 | 12/2013 | Hoffman et al. | |
| 2015/0290794 | A1 * | 10/2015 | Griffith | F04B 53/10 414/4 |
| 2016/0252110 | A1 * | 9/2016 | Galloway | A61F 2/68 60/327 |
| 2017/0020763 | A1 | 1/2017 | Cruz | |
| 2018/0079071 | A1 * | 3/2018 | Griffith | A61H 1/0237 |
| 2018/0296419 | A1 * | 10/2018 | Tong | B25J 9/142 |
| 2018/0303698 | A1 * | 10/2018 | Wijesundara | F15B 15/08 |
| 2019/0015233 | A1 * | 1/2019 | Galloway | A61F 5/05816 |
| 2019/0056248 | A1 * | 2/2019 | Shepherd | B25J 9/142 |

FOREIGN PATENT DOCUMENTS

| | | | | |
|---|---|---|---|---|
| CN | 104970949 | A | 10/2015 | |
| CN | 105726262 | A | 7/2016 | |
| CN | 106074074 | A | 11/2016 | |
| CN | 205698416 | U | 11/2016 | |
| CN | 106794106 | A | 5/2017 | |
| CN | 106880470 | A | 6/2017 | |
| CN | 107184366 | A | 9/2017 | |
| EP | 2332508 | A1 | 6/2011 | |
| EP | 2417941 | A1 | 2/2012 | |
| JP | 2016159049 | A | 9/2016 | |
| WO | 2015102723 | A2 | 7/2015 | |
| WO | 2015191585 | A1 | 12/2015 | |
| WO | WO-2015191007 | A1 * | 12/2015 | A61H 1/0288 |
| WO | 2016056058 | A1 | 4/2016 | |
| WO | WO-2016056058 | A1 * | 4/2016 | A61H 1/02 |
| WO | 2016140115 | A1 | 9/2016 | |
| WO | WO-2016140115 | A1 * | 9/2016 | A61H 1/02 |
| WO | 2017110453 | A1 | 6/2017 | |
| WO | WO-2017199834 | A1 * | 11/2017 | A61H 1/02 |

* cited by examiner

FINGER JOINT REHABILITATION DEVICE

CROSS REFERENCES TO THE RELATED APPLICATIONS

This application is the national phase entry of International Application No. PCT/CN2018/094197, filed on Jul. 3, 2018, which is based upon and claims priority to Chinese Patent Application No. 201710552279.8, filed on Jul. 7, 2017, the entire contents of which are incorporated herein by reference.

TECHNICAL FIELD

The present invention relates to the technical field of joint exercise aid, and in particular to a finger joint rehabilitation device.

BACKGROUND

It has been clinically confirmed that during early rehabilitation and spontaneous recovery after surgery on a patient's limb or for a patient suffering from injury of cranial nerves, implementation of continuous passive exercise can compensate for patient's lack of active exercise, increase the mobility of the limb, and reduce corresponding complications at the same time. In addition, at present, patients suffer from contracture of fingers due to numbness caused by central nervous injury such as cerebral infarction, in which case, if the patient's fingers can be assisted in exercise, the recovery speed of patient's fingers can be increased.

In view of the above defects, the inventor of the present invention finally obtained the present invention after a long period of research and practice.

SUMMARY

To solve the above technical defects, the technical solution used by the present invention is: providing a finger joint rehabilitation device, comprising:

at least one of an index finger joint rehabilitation exercise aid part, a middle finger joint rehabilitation exercise aid part, a ring finger joint rehabilitation exercise aid part, a little finger joint rehabilitation exercise aid part and a thumb joint rehabilitation exercise aid part;

at least one corrugated tube;

one protective brace fixed on a wrist and a palm; and at least one bonding fastener, wherein the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part are all provided with the corrugated tube; and the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part are all fixed onto the protective brace by means of the bonding fastener.

Preferably, the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part each comprises one rubber part, at least one small bracket, one middle bracket and one large bracket, and the small bracket, the middle bracket and the large bracket are all fixed onto the rubber part; and a front end of the rubber part is provided with a finger sheath into which the patient's finger can reach.

Preferably, the small bracket, the middle bracket and the large bracket are all provided with a fixing hole for fixing the corrugated tube.

Preferably, the front end of the finger sheath has an opening from which the patient's finger can reach out, improving the patient's finger touch.

Preferably, the rubber part is provided with at least four raised cylinders, and the small bracket, the middle bracket and the large bracket are all provided with holes that cooperate with the cylinders.

Preferably, when the small bracket, the middle bracket and the large bracket are fixed on the rubber part, a ring hole is provided in the rubber part between the small bracket and the middle bracket and/or between the middle bracket and the large bracket for improving the flexibility of the rubber part.

Preferably, the finger sheath is provided with a flat face segment for supporting the finger.

Preferably, the corrugated tube is a tube with a hollow interior which is formed of several crests and troughs connected alternately, a middle end face of a tail end of the corrugated tube is provided with a boss, with the thickness of the boss being greater than the thickness of the corrugated tube, and both the first section at the head end and the last section at the tail end of the corrugated tube are crests, with the width of both the crest of the first section at the head end and the crest of the last section at the tail end being greater than the thickness of the corrugated tube, preventing the head end and the tail end of the corrugated tube from collapsing inwards when the air pressure in the corrugated tube decreases.

Preferably, an end face of the tail end of the corrugated tube is provided with a chamfer to prevent the head end and the tail end of the corrugated tube from collapsing inwards when the air pressure in the corrugated tube decreases.

Preferably, an end face of the head end of the corrugated tube is provided with an arc surface to prevent the head end and the tail end of the corrugated tube from collapsing inwards when the air pressure in the corrugated tube decreases.

Compared with the prior art, the beneficial effect of the present invention is as follows: the finger joint rehabilitation device helps patients perform rehabilitation training by wearing the rubber part of the finger joint rehabilitation exercise aid part on the patient's finger, fixing the corrugated tube by means of a small bracket, a middle bracket and a large bracket fixed on the rubber part and controlling the air pressure in the corrugated tube such that the corrugated tube forces the rubber part to bend and straighten and drives the patient's fingers to perform exercise at the same time.

BRIEF DESCRIPTION OF THE DRAWINGS

To illustrate the technical solutions in various embodiments of the present invention more clearly, the accompanying drawings to be used in the description of the embodiments will be briefly introduced below.

DETAILED DESCRIPTION OF THE EMBODIMENTS

The above and other technical features and advantages of the present invention will be illustrated in more detail below with reference to the drawings.

[Skeletal Structure]

Before illustration for a joint exercise aid device involved in this embodiment, the skeletal structure of a human hand will be illustrated.

Figure 1:
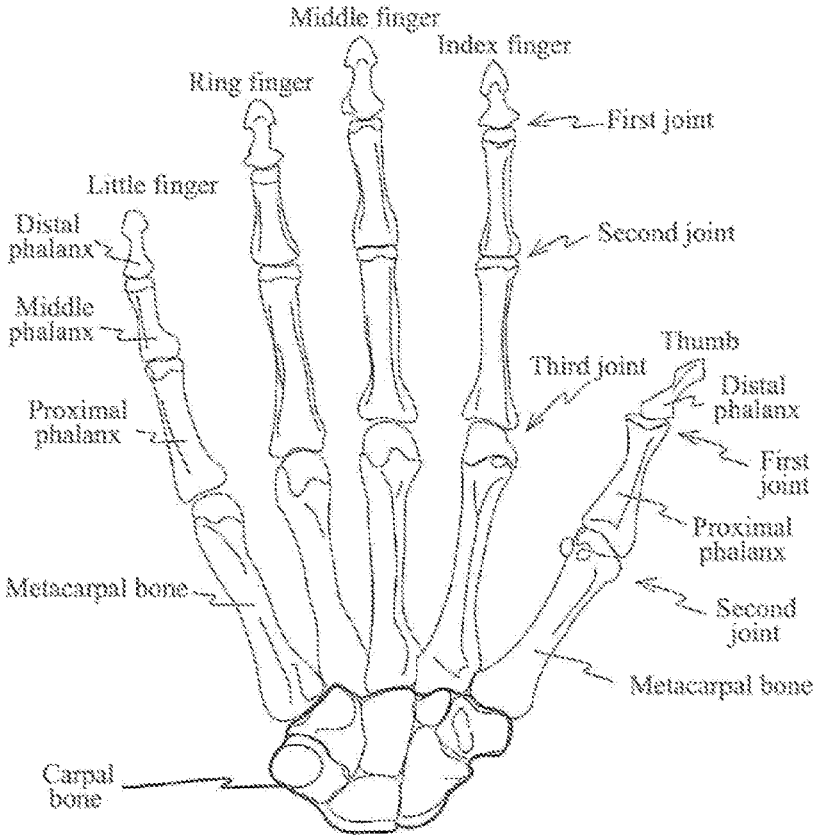
FIG. 1 is a diagram for illustrating the skeletal structure of a human hand.

FIG. 1 is the skeletal structure of a right hand viewed from a palm side, in which metacarpal bones of a thumb, an index finger, a middle finger, a ring finger and a little finger are connected to a carpal bone. The metacarpal bone of the thumb is connected to phalanges composed of a "proximal phalanx" and a "distal phalanx". Regarding the thumb, the distal phalanx of a fingertip is connected to the proximal phalanx through a "first joint", and the proximal phalanx is connected to the metacarpal bone of the thumb through a "second joint".

In addition, metacarpal bones of the index finger, middle finger, ring finger and little finger are respectively connected to phalanges composed of a "proximal phalanx", a "middle phalanx" and a "distal phalanx". Regarding the index finger, the middle finger, the ring finger and the little finger, the distal phalanx of the fingertip is connected to the middle phalanx through a "first joint", and the middle phalanx is connected to the proximal phalanx through a "second joint". Moreover, the proximal phalanx is connected to the metacarpal bone through a "third joint". Furthermore, in the following illustration, the part of a finger where a distal phalanx is used as a bone is referred to as a "distal part", and the part of a finger where a middle phalanx is used as a bone is referred to as a "middle part". In addition, the part of a finger where a proximal phalanx is used as a bone is referred to as a "proximal part". Also, the part where a "metacarpal bone" is used as a bone is referred to as a "metacarpal part".

Figure 2:
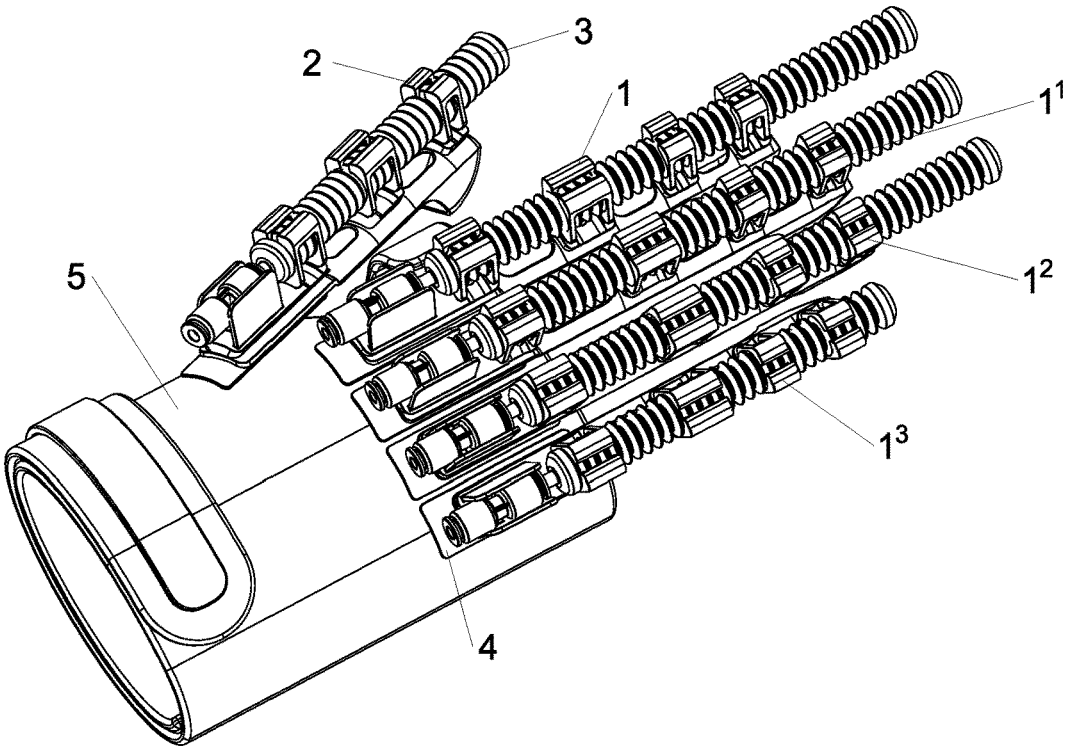
FIG. 2 is a structural diagram of a finger joint rehabilitation device.

FIG. 2 is a finger joint rehabilitation device, which comprises at least one of an index finger joint rehabilitation exercise aid part 1, a middle finger joint rehabilitation exercise aid part $\mathbf{1}^1$, a ring finger joint rehabilitation exercise aid part $\mathbf{1}^2$, a little finger joint rehabilitation exercise aid part $\mathbf{1}^3$ and a thumb joint rehabilitation exercise aid part 2, a corrugated tube 3, a bonding fastener 4 and a protective brace 5. The index finger joint rehabilitation exercise aid part $\mathbf{1}^0$, the middle finger joint rehabilitation exercise aid part $\mathbf{1}^1$, the ring finger joint rehabilitation exercise aid part $\mathbf{1}^2$ and the little finger joint rehabilitation exercise aid part $\mathbf{1}^3$ are identical in structure, the corrugated tube 3 is fixed on the joint rehabilitation exercise aid part of each finger, the joint rehabilitation exercise aid parts on the five fingers are all fixed on the protective brace 5 by means of the bonding fastener 4, and the protective brace 5 is fixed, by means of the hook and loop fastener thereon, onto the palm and the wrist.

[Structure of Finger Joint Rehabilitation Exercise Aid Part]

Figure 3:
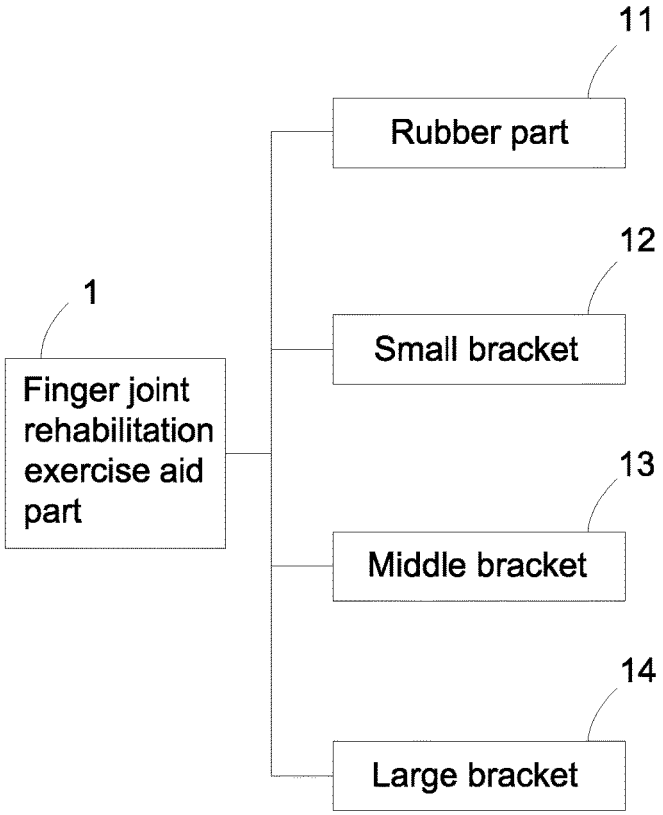
FIG. 3 is a frame diagram of a finger joint rehabilitation exercise aid part.

FIG. 3 is a frame diagram of a finger joint rehabilitation exercise aid part, which comprises a rubber part 11, a small bracket 12, a middle bracket 13 and a large bracket 14. The small bracket 12, the middle bracket 13 and the large bracket 14 are all fixed on the rubber part 11, and a power source corrugated tube 3 is fixed on the rubber part 11 by means of a small bracket 12, the middle bracket 13 and the large bracket 14.

The finger joint rehabilitation exercise aid part can be worn on each finger, but the fingers are different in length and bone structure such that the rubber part structure and the number of small brackets to be worn on each finger will be different. Since the distal phalanx of each finger is short, the corrugated tube is fixed with a small bracket 12, the distal phalanx of the finger is forced to exercise under the action of the power source corrugated tube, and the fixed position of the small bracket 12 on the rubber part corresponds to the distal phalanx of the finger. The index finger, the middle finger, the ring finger and the little finger all have a middle phalanx, and since the middle phalanx is slightly shorter than the proximal phalanx, the power source corrugated tube is also fixed with a small bracket 12 to prevent the corrugated tube from being detached from the rubber part and thus not being able to drive the finger by means of the rubber part, and at this moment the fixed position of the small bracket 12 on the rubber part corresponds to the middle of the middle phalanx of the finger. The five fingers of one hand all have a proximal phalanx, since the proximal phalanx is longer than the middle phalanx, in order to bring the power source closer to the rubber part such that the rubber part is more fit to the finger, a middle bracket 13 is provided on the rubber part to be worn on the thumb at the position of the proximal phalanx close to first joint so as to fix the power source corrugated tube, and in addition, middle brackets 13 are provided on the rubber parts to be worn on the index finger, the middle finger, the ring finger and the little finger at the position of the corresponding middle phalanx close to second joint so as to fix the power source corrugated tube. The large brackets 14 are provided on the rubber part to be worn on the five fingers at positions respectively corresponding to the end of the proximal phalanx and the metacarpal bone so as to fix the power source. As such, one small bracket 12, one middle bracket 13 and one large bracket 14 are provided on the rubber part to be worn on the thumb, and two small brackets 12, one middle bracket 13 and one large bracket 14 are provided on the other four fingers, such that the rubber part to be worn on the thumb is different in structure from the rubber parts to be worn on the other four fingers.

[Structure of Finger Joint Rehabilitation Exercise Aid Parts on the Index Finger, the Middle Finger, the Ring Finger and the Little Finger]

Figure 4:
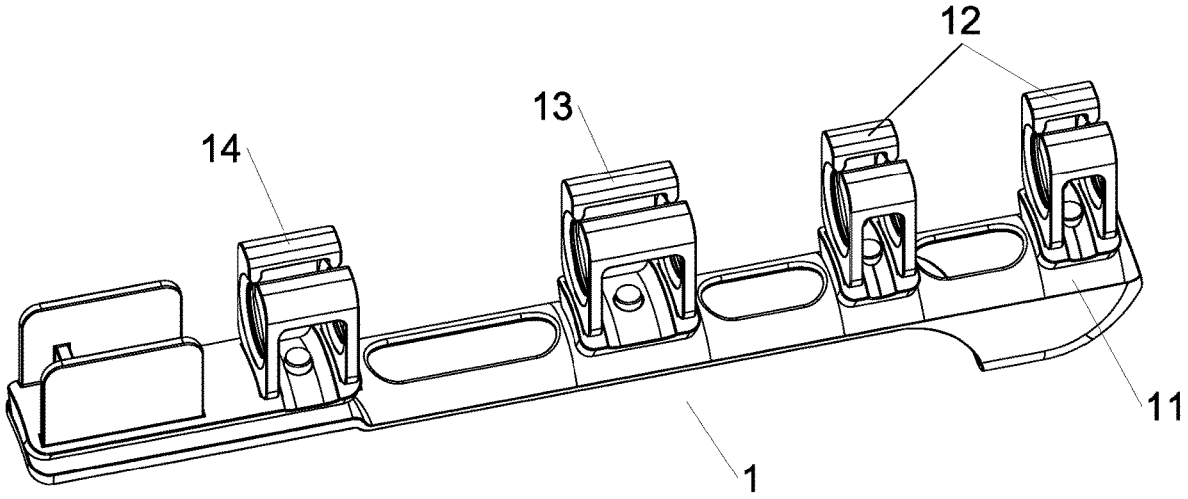
FIG. 4 is a structural diagram of a finger joint rehabilitation exercise aid part to be worn on an index finger, a middle finger, a ring finger and a little finger.

FIG. 4 is a structural diagram of a finger joint rehabilitation exercise aid part that can be worn on the index finger, the middle finger, the ring finger and the little finger, which is the index finger joint rehabilitation exercise aid part 1, the middle finger joint rehabilitation exercise aid part $1^1$, the ring finger joint rehabilitation exercise aid part $1^2$ and the little finger joint rehabilitation exercise aid part $1^3$, comprising a rubber part 11, a small bracket 12, a middle bracket 13 and a large bracket 14. The small bracket 12, the middle bracket 13 and the large bracket 14 are all fixed on the rubber part 11.

Figure 5:
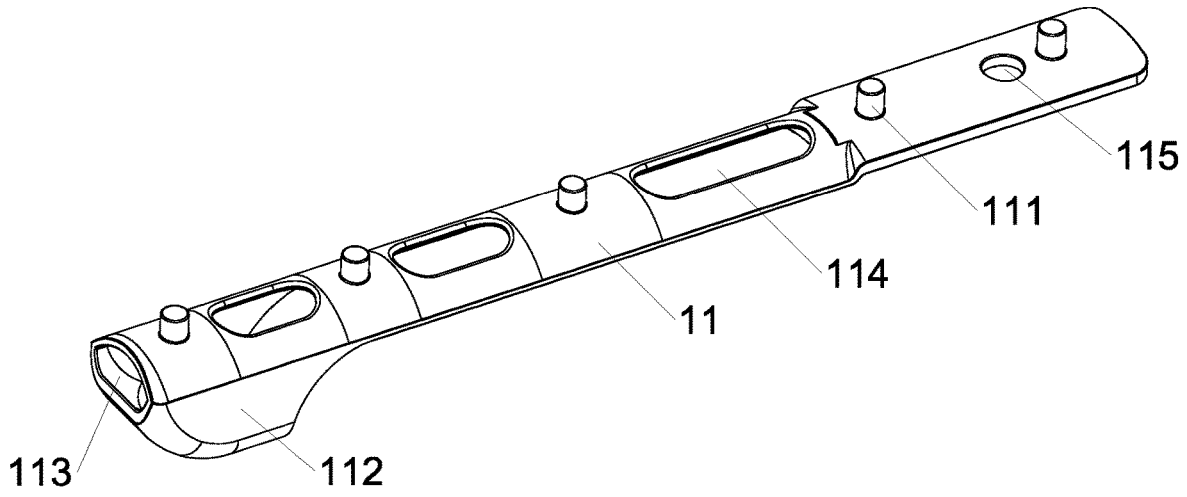
FIG. 5 is a front view of a rubber part to be worn on an index finger, a middle finger, a ring finger and a little finger.
Figure 6:
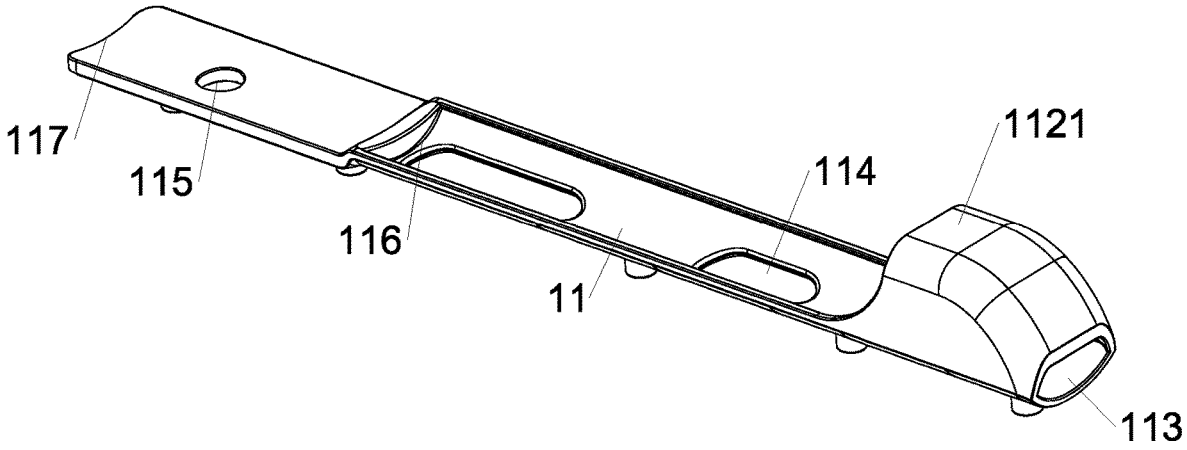
FIG. 6 is a reverse view of a rubber part to be worn on an index finger, a middle finger, a ring finger and a little finger.

The rubber part 11 can be sheathed on a patient's finger, and the material thereof is rubber, especially medical silicone, and has strong flexibility to adapt to different deformation of the patient's finger. FIGS. 5 and 6 are respectively the front side and the reverse side of the rubber part 11. The front side of the rubber part 11 is provided with multiple raised cylinders 111 for fixing the small bracket 12, the middle bracket 13 and the large bracket 14 to the rubber part 11, with the number of the raised cylinders 111 being the same as the total number of the small bracket 12, the middle bracket 13 and the large bracket 14. A front end of the rubber part 11 has a finger sheath 112, which is open at a front end thereof, that is, the rubber part 11 has an open end 113, and the patient's finger reaches into the finger sheath 12 and out from the open end 113, so that the patient's finger is exposed, which can improve the patient's finger touch and is advantageous for the rehabilitation of the patient's fingers. The finger sheath 112 is provided, at a position where it is in contact with the finger pulp, with a flat face segment 1121 for supporting the finger, and the finger is kept straight when it is forced to straighten under the drive of the power source. A ring opening 114 is provided between the small bracket 12 and the middle bracket 13 and/or between the middle bracket 13 and the large bracket 14 on the rubber part 11, which improves the flexibility of the rubber part at the periphery of the ring opening 114, and when the patient's finger bends and spreads, the rubber part 11 with the ring opening 114 tightly fits with the patient's finger, which is more helpful for the patient to perform follow action with the aid of the finger joint rehabilitation exercise aid part, facilitating rehabilitation of the patient. The rubber part 11 is further provided with a hole 115 for fixing the rubber part 11 to other aid structures through the hole 115. The curvature of a curved surface 116 of the back side of the rubber part 11 cooperating with the finger is greater than that of a curved surface 117, which facilitates closely fitting with the patient's finger, such that when the rubber part 11 is driven by the power source to bend and stretch, the patient's finger can accurately and synchronously move therewith without lag, and the curvature of the curved surface 117 is smaller for fixedly connection with other aid parts.

Figure 7:
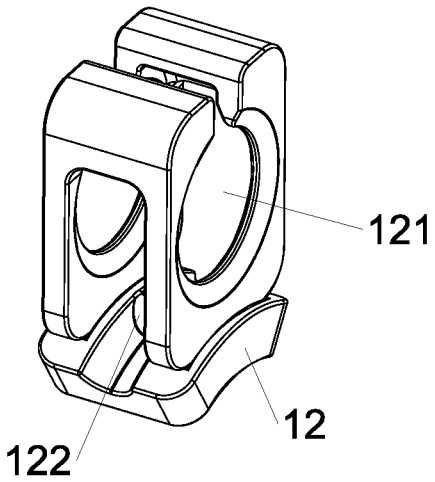
FIG. 7 is a structural diagram of a small bracket.
Figure 8:
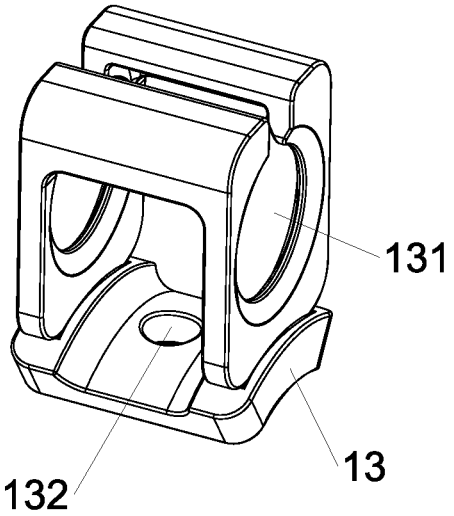
FIG. 8 is a structural diagram of a middle bracket.
Figure 9:
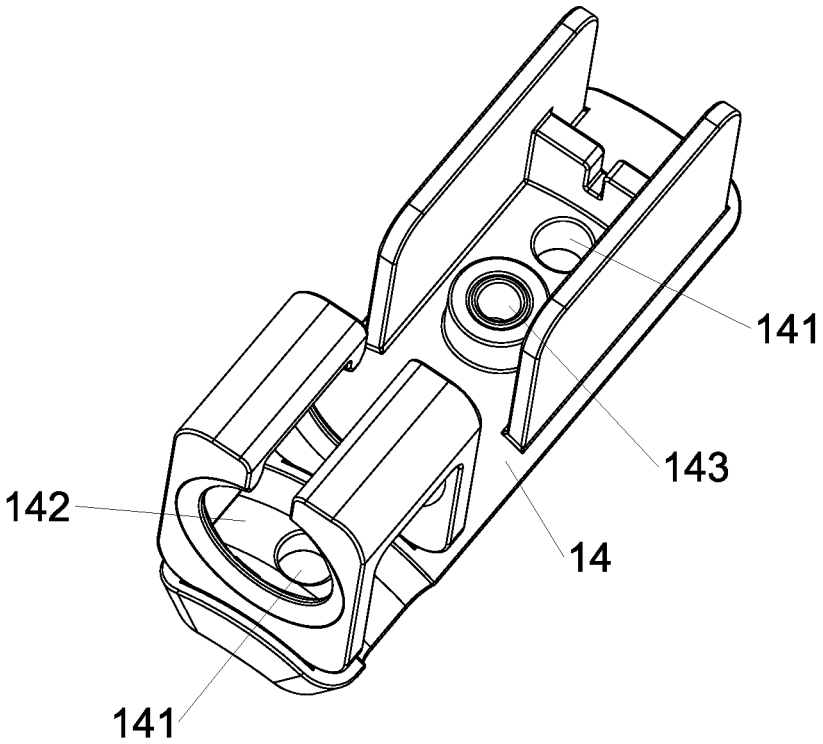
FIG. 9 is a structural diagram of a large bracket.

FIGS. 7, 8 and 9 are structural diagrams of the small bracket 12, the middle bracket 13, and the large bracket 14, respectively. In FIG. 7, the small bracket 12 has a fixing hole 121 such that a power source, such as a corrugated tube, that forces the rubber part 11 to bend and straighten is placed into the fixing hole 121 and is fixed, and a fixing hole 122 that cooperates with the cylinder 111 such that when the cylinder 111 extends into the hole 122, the small bracket is fixed onto the rubber part 11.

As shown in FIG. 8, the structure of the middle bracket 13 is the same as that of the small bracket 12, except that when the middle bracket 13 and the small bracket 12 are fixed on the rubber part 11, the length of the middle bracket 13 in the lengthwise direction of the finger is greater than the length of the small bracket 12, the middle bracket 13 is further provided with a fixing hole 131 such that a power source, such as a corrugated tube, that forces the rubber part 11 to bend and straighten, is placed into the large hole 131 and is fixed, and a fixing hole 132 that cooperates with the cylinder 111 such that the middle bracket is fixed on the rubber part 11.

As shown in FIG. 9, the large bracket 14 is different in structure from the small bracket 12 and the middle bracket 13, the large bracket 14 has a greater length and is provided with two holes 141 that cooperate with the cylinder 111 to facilitate fixing the large bracket 14 onto the rubber part 11. The large bracket is further provided with a fixing hole 142 such that a power source, such as a corrugated tube, that forces the rubber part 11 to bend and straighten is placed into the large hole 142 and is fixed, and a hole 143 through which the large bracket 14, the rubber part 11 and other aid parts are fixed together.

Since the small bracket 12, the middle bracket 13 and the large bracket 14 need to be worn for a long time, the materials thereof are all lightweight materials, for example, a light material such as plastic.

The finger joint rehabilitation exercise aid parts on the index finger, the middle finger, the ring finger and the little finger have the same structure, but the four fingers are different in length, so that the length of the rubber parts will be different, and the distance between the corresponding cylinders 111 will be adjusted.

The finger joint rehabilitation exercise aid part is driven by the power source to bend and stretch and at the same time, drives the patient's fingers to perform bending and stretching exercise, thereby helping the patient perform rehabilitation training.

[Structure of Finger Joint Rehabilitation Exercise Aid Part on the Thumb]

The difference between the finger joint rehabilitation exercise aid part to be worn on the thumb and the finger joint rehabilitation exercise aid parts to be worn on other fingers lies in that one small bracket is fixed on the rubber part to be worn on the thumb, and two small brackets are fixed on the rubber part to be worn on other fingers, so the rubber parts to be worn on the thumb have different technical features from the rubber parts to be worn on other fingers.

Figure 10:
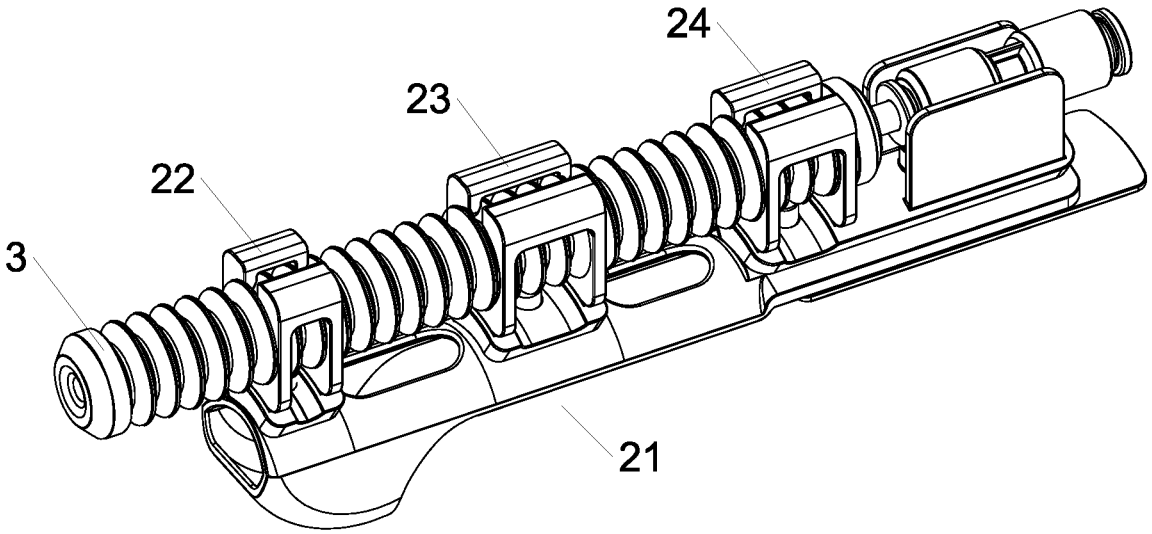
FIG. 10 is a structural diagram of a finger joint rehabilitation exercise aid part to be worn on a thumb.

FIG. 10 is a finger joint rehabilitation exercise aid part to be worn on the thumb, which comprises a rubber part 21, a small bracket 22, a middle bracket 23 and a large bracket 24, wherein the small bracket 22, the middle bracket 23 and the large bracket 24 are fixed on the rubber part 21, and the power source corrugated tube 3 is fixed with the small bracket 22, the middle bracket 23 and the large bracket 24.

Figure 11:
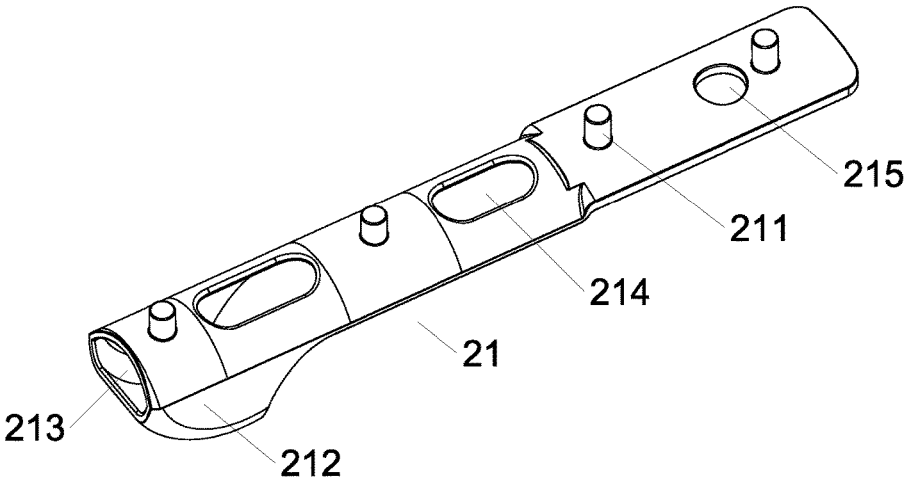
FIG. 11 is a structural diagram of a rubber part to be worn on a thumb.

FIG. 11 is a rubber part 21 to be worn on the thumb. The thumb has only three joints, including the distal phalanx, the proximal phalanx and the metacarpal bone. Since the distal phalanx is relatively short, a small bracket 22 is provided on the rubber part 21 to fix the power source (corrugated tube); since the proximal phalanx and the metacarpal bone are relatively long, the middle bracket 23 is provided on the rubber part at a position corresponding to the proximal phalanx close to the first joint of the thumb so as to fix the power source (corrugated tube), and the large bracket 24 is provided on the rubber part 21 at a position corresponding to the end of the proximal phalanx and the metacarpal bone so as to fix the power source (corrugated tube); and the rubber part 21 to be worn on the thumb is provided with four raised cylinders 211 (the same as the cylinder 111) respectively used for fixing the small bracket 22, the middle bracket 23 and the large bracket 24. As such, the small bracket with a smaller length is provided on the rubber part at the position corresponding to the shorter distal phalanx, and the middle bracket 23 and the large bracket 24 are respectively provided on the rubber part at the position corresponding to the longer proximal phalanx and the metacarpal bone, so that the rubber part fit more closely with the power source, which is more advantageous for controlling the deformation of the rubber part to allow the rubber part to fit on the finger, so that the power source (corrugated tube) controls the bending and stretching of the finger. The rubber part 21 is provided with a ring hole 214 (the same as the ring hole 114) is provided between the small bracket 22 and the middle bracket 23 and/or between the middle bracket 23 and the large bracket 24, the rubber part 11 to be worn on other fingers is provided with three ring holes, and providing the ring holes is advantageous for improving the fitting of the rubber part to the patient's finger. The rubber part 21 is also provided with a finger sheath 212, with a front end thereof having an opening 213, so that the patient's finger reaches into the finger sheath 212, and the fingertip is exposed out of the opening 213, the finger being exposed to the outside improving the patient's finger touch, which is advantageous for the rehabilitation of the patient. Also, the rubber part 21 is provided with a hole 215, such that the rubber part 21 is fixed, through the hole 215, together with other aid parts. The small bracket, the middle bracket and the large bracket to be worn on the thumb have the same structure and size as those to be worn on other fingers.

As such, the finger joint rehabilitation exercise aid part to be worn on the thumb is driven by the power source to bend and stretch and at the same time, drives the patient's fingers to perform bending and stretching exercise, thereby helping the patient perform rehabilitation training.

[Structure of Corrugated Tube]

Figure 12:
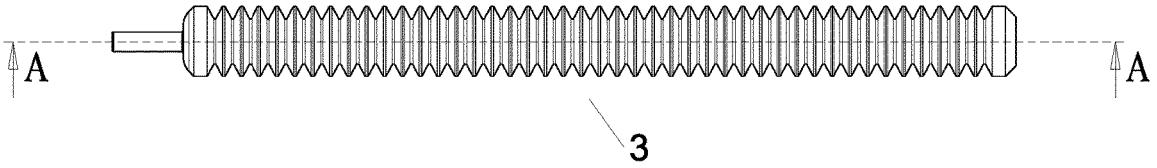
FIG. 12 is a structural diagram of a corrugated tube.

FIG. 12 is a structural diagram of a corrugated tube. The corrugated tube is fixed on a rubber part on a joint rehabilitation exercise aid part on each finger by means of the small bracket, the middle bracket and the large bracket, the corrugated tube is hollow inside, and by means of filling air into and extracting air from the corrugated tube, the air pressure in the corrugated tube is controlled to force the corrugated tube to perform stretching and compression, so that the bones in need of rehabilitation exercise are forced to move under the drive of the stretching and compression of the corrugated tube. The material of the corrugated tube is high-pressure polyethylene (HDPE) or ethylene (EVA).

Figure 13:
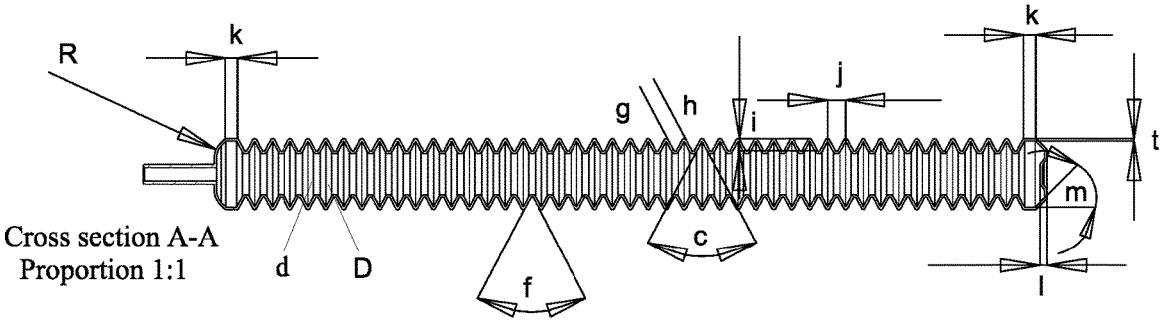
FIG. 13 is a sectional diagram of a corrugated tube.

FIG. 13 is a cross-sectional view of a corrugated tube. It can be seen from the figure that the corrugated tube is a flexible tube composed of alternating crests and troughs. The top angle e of each crest and is equal to the bottom angle f of the trough, so sides g and h of two crests in the same direction are parallel to each other. When the angles e and f are both equal to 90 degrees, the compression performance and stretching performance of the corrugated tube are equal. When the angles e and f are both an acute angle, if the angles e and f are both pulled from the acute angle to the straight angle, the stretching space is large, but the stretching resistance will also be very large, and due to the influence of the material of the corrugated tube and the excessive stretching angle, the corrugated tube will not return to the original state when the angles e and f become straight angle. On the contrary, if the corrugated tube is compressed, since it is relatively easy to compress the angles e and f from an acute angle to zero degree, and for a triangle enclosed by one crest and two troughs, since the crest at the top angle is an acute angle and thus this triangle has a relatively small stiffness at the top angle so that the two troughs are relatively easy to be compressed, the compression performance is greater than the stretching performance at this time. When the angles e and f are both an obtuse angle, it is relatively easy for the angles e and f to change from an obtuse angle to a straight angle, and for a triangle enclosed by one crest and two troughs, since the crest at the top angle is an obtuse angle and thus this triangle has a large stiffness at the top angle so that the two troughs cannot be easily compressed when being compressed, the stretching performance of the corrugated tube is greater than the compression performance at this time. For this patent, if the patient's bones bend and deform and cannot be straightened, and need to change from bending to straightening, the working state of the corrugated tube is from an original bent state to a compressed state, which requires the compression performance of the corrugated tube to be greater than the stretching performance.

In FIG. 13, the angles e and f are both an acute angle, the compression performance of the corrugated tube is greater than the stretching performance, which is adapted to the case where the patient's limbs are in a bent state and need to be straightened. The larger the height difference between the crest and trough, i.e., the crest height i, the better the compression performance of the corrugated tube, but when the outer diameter D of the corrugated tube is fixed, the larger the crest height i, the smaller the inner diameter d, which will affect the filling volume of the corrugated tube. If a value of the thickness t of the corrugated tube is too large, it will affect the stretching performance and the compression performance thereof, and the thickness t is associated with the air pressure that the corrugated tube bears, i.e., the greater the air pressure, the greater the thickness t, the thickness of the corrugated tube used to aid in the finger exercise in FIG. 2 is 0.5 mm.

In order to prevent the corrugated tube from collapsing inwards at both ends when the corrugated tube is compressed, that is, when the air pressure in the corrugated tube becomes low, the corrugated tube is strengthened in strength at both ends, the middle of the bottom of the tail end is additionally provided with a boss with the thickness of 1, the crest width of the last section increases from t to k, and the end face is additionally provided with a chamfer m, which improves the strength of the tail end of the last corrugated tube such that when the air pressure in the corrugated tube decreases, the tail end of the corrugated tube will not collapse inwards to affect the effect in use. The crest width of the first section of the head end of the corrugated tube also increases from t to k, and the end face is additionally provided with an arc surface, which prevents the head end of the corrugated tube from collapsing inwards when the air pressure in the corrugated tube decreases.

Of course, the corrugated tube can also be used in other situations, such as assisting patients in bending training from a stiff state, joint rehabilitation training of the waist, legs and arms, in such cases the corrugated tube may vary in diameter, thickness and length, depending on the application.

[Structure of Bonding Fastener]

Figure 14:
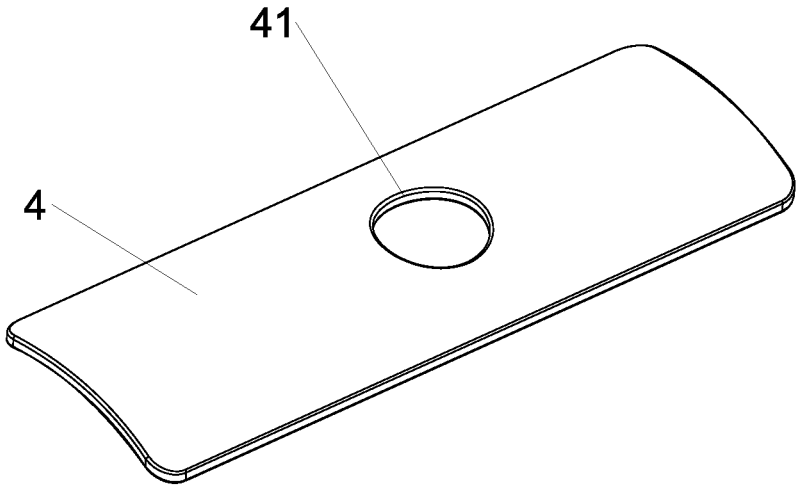
FIG. 14 is a structural diagram of a bonding fastener.

FIG. 14 is a structural diagram of a bonding fastener. The bonding fastener 4 is placed under the rubber part, the large bracket is placed above the rubber part 11 or 21, and the three are fixed together by means of a hole 141 on the large bracket, a hole 41 on the bonding fastener, and a hole 115 on the rubber part 11 or a hole 215 on the rubber part 21. The front side of the bonding fastener 4 does not have a bonding property and is not fixed to the rubber part by bonding, but the reverse side of the bonding fastener 4 has a bonding property and is bonded to a protective brace 5, and the position of the bonding fastener on the protective brace 5 can be adjusted so as to adapt to different people's hands.

[Structure of Protective Brace]

Figure 15:
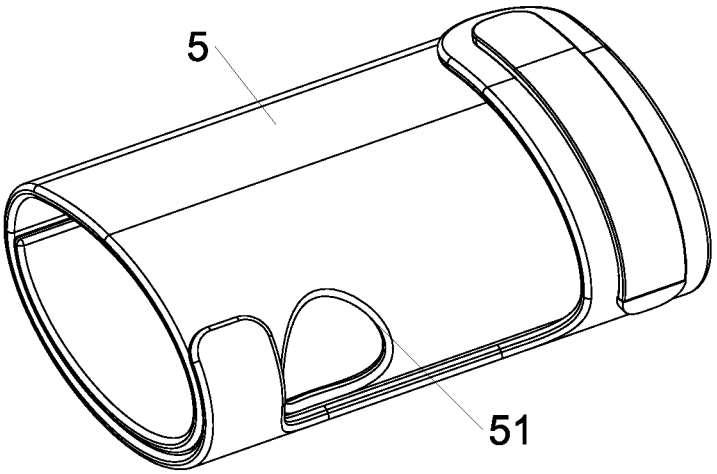
FIG. 15 is a state diagram of a protective brace when it is rolled up.
Figure 16:
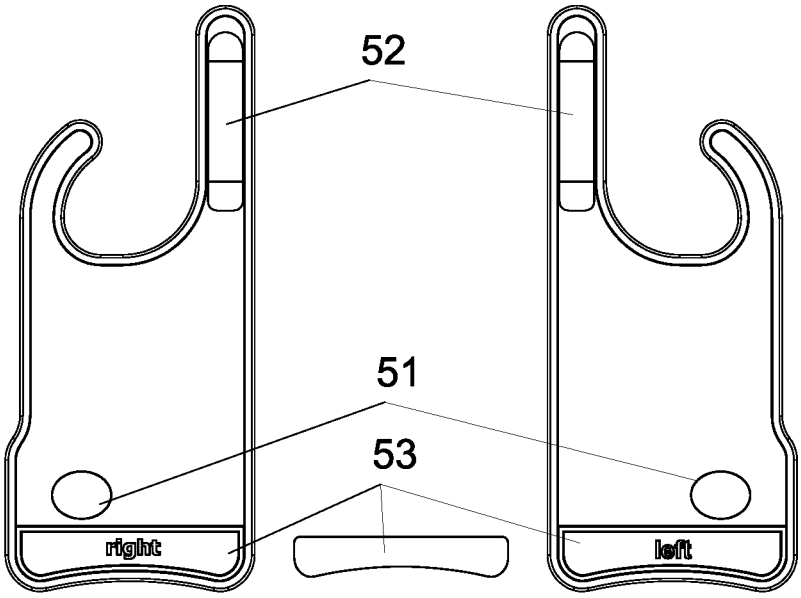
FIG. 16 is a front view of a protective brace when it is unrolled.
Figure 17:
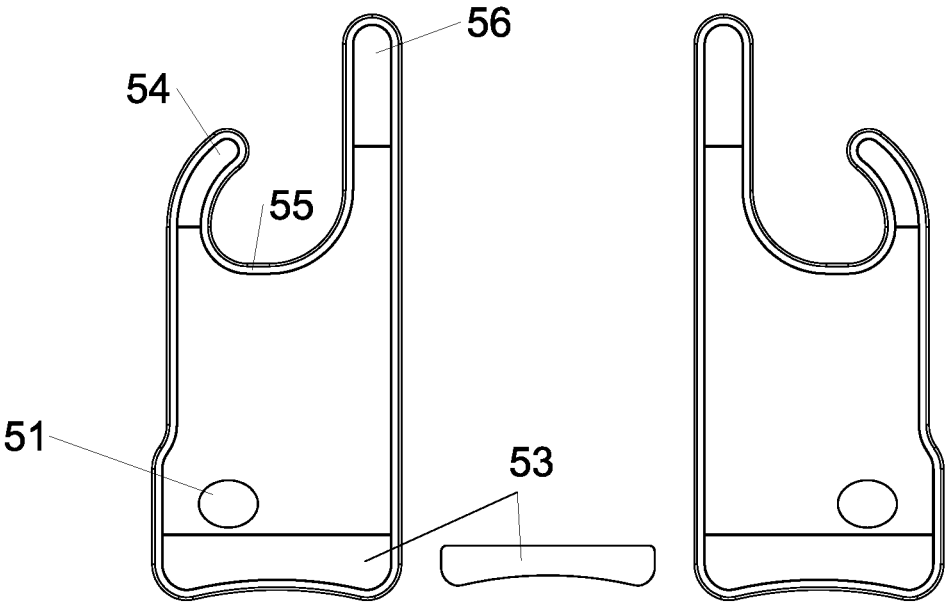
FIG. 17 is a reverse view of a protective brace when it is unrolled.

The protective brace 5, as shown in FIGS. 15 to 17, is to be worn at positions of the palm and the wrist. FIG. 15 shows a state when the protective brace is rolled up, with the thumb reaching out from a hole 51. FIGS. 16 and 17 respectively show two states of the front side and the reverse side of the protective brace 5 when it is unrolled. The front side is provided with a bonding fastener 52 such that when the protective brace is rolled up, the bonding fastener 52 is bonded to the surface of the protective brace for binding and fixing same. One end of the protective brace is embedded with a hard sheet 53 which, when the protective brace is rolled up and bound to the palm and the wrist, facilitates operation to improve the tightness of binding. The hard sheet may be of a hard structure, such as steel plate or an aluminum sheet. An end portion 54 has a certain degree of curvature, such that when the bonding fastener on the end portion 54 is bonded to the protective brace, the bonding position is close to the thumb, so as to avoid affection to the bonding of the index finger exercise aid part 1 to the protective brace 5. The width at 55 is larger, so the width of an end portion 56 decreases, which is advantageous for the bonding of the thumb exercise aid part 2 to the protective brace 5. The protective brace 5 requires being breathable, dirt-proof and lightness, which is convenient for patients to wear for a long time. In addition, the protective brace 5 requires having strong elasticity and flexibility, which is convenient to wear. The surface of the protective brace 5 is to be bonded to the bonding fastener, which is convenient for fixing the finger exercise aid parts of the five fingers. The material of the protective brace 5 may be composite waterproof stretch velvet, and other materials in line with the characteristics of the protective brace can all be used.

When in use, the protective brace 5 is first worn on the palm and the wrist, then the five finger exercise aid parts are worn and bonded, the five finger exercise aid parts are connected to other apparatus, and the air pressure in the corrugated tube is controlled to drive the corrugated tube to perform bending and compression and drive the patient's fingers to perform rehabilitation training, thus helping rehabilitation of patients.

Patients can wear the finger exercise aid parts according to the condition of finger paralysis, i.e., if a certain finger is not paralyzed or deformed, it does need to wear, and only the finger that cannot stretch needs to wear.

The apparatus that controls the air pressure in the corrugated tube is any apparatus that can perform suction, compression and exhaust, such as an electric air pump, a manual air pump, a foot-operated air pump, etc.

The above are only the preferred embodiments of the present invention, and are merely illustrative but not restrictive for the present invention. It will be understood by those skilled in the art that many changes, modifications and equivalents can be made within the spirit and scope as defined by the claims of the present invention, but will fall within the scope of protection of the present invention.

What is claimed is:

1. A finger joint rehabilitation device, comprising:

at least one of an index finger joint rehabilitation exercise aid part, a middle finger joint rehabilitation exercise aid part, a ring finger joint rehabilitation exercise aid part, a little finger joint rehabilitation exercise aid part and a thumb joint rehabilitation exercise aid part;

at least one corrugated tube;

one protective brace configured to be fixed on a wrist and a palm; and at least one bonding fastener, wherein each of the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part is provided with the at least one corrugated tube;

the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part are all fixed on the protective brace by the at least one bonding fastener; and the at least one corrugated tube is a tube with a hollow interior wherein the hollow interior is formed of a plurality of crests and a plurality of troughs connected alternately, a middle end face of a tail end of the at least one corrugated tube is provided with a boss, with a thickness of the boss being greater than a thickness of the at least one corrugated tube, and both a first section at a head end and a last section at the tail end of the at least one corrugated tube are the plurality of crests, with a width of both a crest of the first section at the head end and a crest of the last section at the tail end being greater than the thickness of the at least one corrugated tube, preventing the head end and the tail end of the at least one corrugated tube from collapsing inwards when an air pressure in the at least one corrugated tube decreases.

2. The finger joint rehabilitation device according to claim 1, wherein the index finger joint rehabilitation exercise aid part, the middle finger joint rehabilitation exercise aid part, the ring finger joint rehabilitation exercise aid part, the little finger joint rehabilitation exercise aid part and the thumb joint rehabilitation exercise aid part each comprises a rubber part, a small bracket, a middle bracket and a large bracket, and the small bracket, the middle bracket and the large bracket are fixed on the rubber part; and a front end of the rubber part is provided with a finger sheath wherein into the finger sheath a patient's finger reaches.

3. The finger joint rehabilitation device according to claim 2, wherein each of the small bracket, the middle bracket and the large bracket is provided with a fixing hole for fixing the at least one corrugated tube.

4. The finger joint rehabilitation device according to claim 3, wherein a front end of the finger sheath has an opening wherein from the opening the patient's finger reaches out.

5. The finger joint rehabilitation device according to claim 4, wherein the rubber part is provided with at least four raised circular columns, and each of the small bracket, the middle bracket and the large bracket is provided with a plurality of holes wherein the plurality of holes cooperate with the at least four raised circular columns.

6. The finger joint rehabilitation device according to claim 5, wherein when the small bracket, the middle bracket and the large bracket are fixed on the rubber part, an annular hole is provided in the rubber part between the small bracket and the middle bracket and/or between the middle bracket and the large bracket for improving a flexibility of the rubber part.

7. The finger joint rehabilitation device according to claim 6, wherein the finger sheath is provided with a flat face segment for supporting the patient's finger.

8. The finger joint rehabilitation device according to claim 1, wherein an end face of the tail end of the at least one corrugated tube is provided with a chamfer to prevent the head end and the tail end of the at least one corrugated tube from collapsing inwards when the air pressure in the at least one corrugated tube decreases.

9. The finger joint rehabilitation device according to claim 8, wherein an end face of the head end of the at least one corrugated tube is provided with an arc surface to prevent the head end and the tail end of the at least one corrugated tube from collapsing inwards when the air pressure in the at least one corrugated tube decreases.

* * * * *